US009217323B2

(12) United States Patent
Clark

(10) Patent No.: US 9,217,323 B2
(45) Date of Patent: Dec. 22, 2015

(54) MECHANICAL CALIPER SYSTEM FOR A LOGGING WHILE DRILLING (LWD) BOREHOLE CALIPER

(71) Applicant: Schlumberger Technology Corporation, Sugar Land, TX (US)

(72) Inventor: Brian Oliver Clark, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 412 days.

(21) Appl. No.: 13/802,778

(22) Filed: Mar. 14, 2013

(65) Prior Publication Data

US 2014/0083771 A1 Mar. 27, 2014

Related U.S. Application Data

(60) Provisional application No. 61/704,610, filed on Sep. 24, 2012, provisional application No. 61/704,805, filed on Sep. 24, 2012, provisional application No. 61/704,758, filed on Sep. 24, 2012.

(51) Int. Cl.

| | |
|---|---|
| ***E21B 47/08*** | (2012.01) |
| ***E21B 47/12*** | (2012.01) |
| ***E21B 10/32*** | (2006.01) |

(52) U.S. Cl.

CPC ..... *E21B 47/08* (2013.01); *E21B 10/32* (2013.01); *E21B 47/122* (2013.01)

(58) Field of Classification Search

CPC ..... E21B 47/08; E21B 47/122; E21B 10/32
See application file for complete search history.

(56) References Cited

U.S. PATENT DOCUMENTS

| | | | | | |
|---|---|---|---|---|---|
| 3,283,833 | A | * | 11/1966 | Bodine, Jr. | 175/56 |
| 4,302,881 | A | * | 12/1981 | Schwind et al. | 33/544.3 |
| 5,394,951 | A | | 3/1995 | Pringle et al. | |
| 5,469,736 | A | * | 11/1995 | Moake | 73/152.58 |
| 5,548,900 | A | * | 8/1996 | Hunt-Grubbe | 33/302 |
| 6,047,784 | A | | 4/2000 | Dorel | |
| 6,392,561 | B1 | | 5/2002 | Davies et al. | |

(Continued)

FOREIGN PATENT DOCUMENTS

| | | | |
|---|---|---|---|
| EP | 377257 | A | 7/1990 |
| RU | 2213370 | C2 | 9/2003 |
| RU | 2418148 | C1 | 5/2011 |

OTHER PUBLICATIONS

International Search Report and the Written Opinion for International Application No. PCT/US2013/061138 dated Jan. 10, 2014.

*Primary Examiner* — Jennifer H Gay
(74) *Attorney, Agent, or Firm* — John Vereb

(57) ABSTRACT

A logging while drilling (LWD) caliper includes a drill collar, at least one movable pad, a hinge coupler, a power transmitter and a power receiver. The hinge coupler couples the movable pad to the drill collar in such a way that the movable pad can move between an open position and a closed position. The power transmitter is coupled to the drill collar in such a way that the power transmitter receives power from the drill collar. The power receiver is coupled to the movable pad in such a way that the power receiver provides power to the movable pad. Also, the power transmitter is coupled to the drill collar and the power receiver is coupled to the movable pad is such a way that power is transmitted from the power transmitter to the power receiver.

21 Claims, 13 Drawing Sheets

(56) References Cited

U.S. PATENT DOCUMENTS

| | | | | |
|---|---|---|---|---|
| 6,419,014 | B1 | 7/2002 | Meek et al. | |
| 6,427,783 | B2 | 8/2002 | Krueger et al. | |
| 6,533,178 | B1 * | 3/2003 | Gaul et al. | 235/492 |
| 7,190,084 | B2 | 3/2007 | Hall et al. | |
| 7,389,828 | B2 * | 6/2008 | Ritter et al. | 175/40 |
| 7,552,761 | B2 | 6/2009 | Moriarty | |
| 7,591,304 | B2 | 9/2009 | Juhasz et al. | |
| 7,666,668 | B2 | 2/2010 | Bujard et al. | |
| 8,146,679 | B2 | 4/2012 | Downton | |
| 8,408,333 | B2 | 4/2013 | Pai et al. | |
| 2004/0094303 | A1 | 5/2004 | Brockman et al. | |
| 2005/0252688 | A1 | 11/2005 | Head et al. | |
| 2006/0054354 | A1 | 3/2006 | Orban | |
| 2006/0113111 | A1 * | 6/2006 | Martinez et al. | 175/45 |
| 2006/0249307 | A1 * | 11/2006 | Ritter et al. | 175/40 |
| 2006/0260806 | A1 | 11/2006 | Moriarty | |
| 2007/0261887 | A1 | 11/2007 | Pai et al. | |
| 2008/0266577 | A1 * | 10/2008 | Prouvost et al. | 356/626 |
| 2008/0277163 | A1 | 11/2008 | Moriarty | |
| 2010/0018770 | A1 | 1/2010 | Moriarty et al. | |
| 2010/0282511 | A1 * | 11/2010 | Maranuk et al. | 175/40 |
| 2014/0059874 | A1 * | 3/2014 | Sallwasser | 33/544.3 |
| 2014/0083768 | A1 * | 3/2014 | Moriarty et al. | 175/40 |
| 2014/0083769 | A1 * | 3/2014 | Moriarty et al. | 175/40 |
| 2014/0083770 | A1 * | 3/2014 | Codazzi et al. | 175/40 |
| 2014/0083771 | A1 * | 3/2014 | Clark | 175/40 |
| 2014/0084946 | A1 * | 3/2014 | Clark et al. | 324/654 |
| 2014/0090898 | A1 * | 4/2014 | Moriarty et al. | 175/78 |
| 2014/0097026 | A1 * | 4/2014 | Clark et al. | 175/61 |
| 2014/0131104 | A1 * | 5/2014 | Coley et al. | 175/48 |
| 2014/0138084 | A1 * | 5/2014 | Al-Mulhem | 166/255.1 |
| 2014/0159502 | A1 * | 6/2014 | Shimokawa et al. | 307/104 |

* cited by examiner

MECHANICAL CALIPER SYSTEM FOR A LOGGING WHILE DRILLING (LWD) BOREHOLE CALIPER

CROSS-REFERENCE TO RELATED APPLICATIONS

This application claims the benefit of and priority to U.S. Provisional Patent Application Ser. No. 61/704,610, entitled "Mechanical Caliper System For A Logging While Drilling Borehole Caliper," and filed on Sep. 24, 2012, U.S. Provisional Patent Application Ser. No. 61/704,805, entitled "System And Method for Wireless Power And Data Transmission In A Mud Motor," and filed on Sep. 24, 2012, and U.S. Provisional Patent Application Ser. No. 61/704,758, entitled "Positive Displacement Motor Rotary Steerable System And Apparatus," and filed on Sep. 24, 2012, the disclosures of which are hereby incorporated by reference in their entireties.

DESCRIPTION OF THE RELATED ART

Several conventional logging while drilling ("LWD") calipers for determining the borehole diameter currently exist. However, current LWD calipers are limited in various ways. Some of the caliper measurements are secondary, in that they involve small changes in other quantities that are the primary property being measured. For example, a common type of LWD tool measures rock formation resistivity using 2 MHz electromagnetic waves. The resistivity caliper is based on small changes in the phases and amplitudes of the electromagnetic waves, and it does not work in oil based mud, and it only provides an average diameter. The LWD tool that measures rock formation density uses gamma-rays, which pass through the drilling fluid (or "mud"). As the mud has a different density than the rock formation, subtle differences in the count-rates at two detectors depend on the gap between the density sensors and the borehole wall. The density caliper can only be acquired while drilling, and is limited to measuring relatively small washouts, e.g., less than 1 inch. The ultrasonic caliper sends pulses toward the borehole wall and records the round-trip travel time. However, it has a relatively limited range in relatively heavy muds and cannot be obtained on the trip out. In wireline, mechanical calipers are used where one or more arms are deployed when logging out of the borehole. The mechanical wireline calipers make direct and accurate measurements of the borehole diameter, and can even measure non-circular boreholes.

SUMMARY OF THE DISCLOSURE

A logging while drilling (LWD) caliper includes a drill collar, at least one movable pad, a hinge coupler, a power transmitter and a power receiver. The hinge coupler couples the movable pad to the drill collar in such a way that the movable pad can move between an open position and a closed position. The power transmitter is coupled to the drill collar in such a way that the power transmitter receives power from the drill collar. The power receiver is coupled to the movable pad in such a way that the power receiver provides power to the movable pad. Also, the power transmitter is coupled to the drill collar and the power receiver is coupled to the movable pad in such a way that power is transmitted from the power transmitter to the power receiver whereby the movable pad moves between the open position and the closed position.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

Figure 1A:
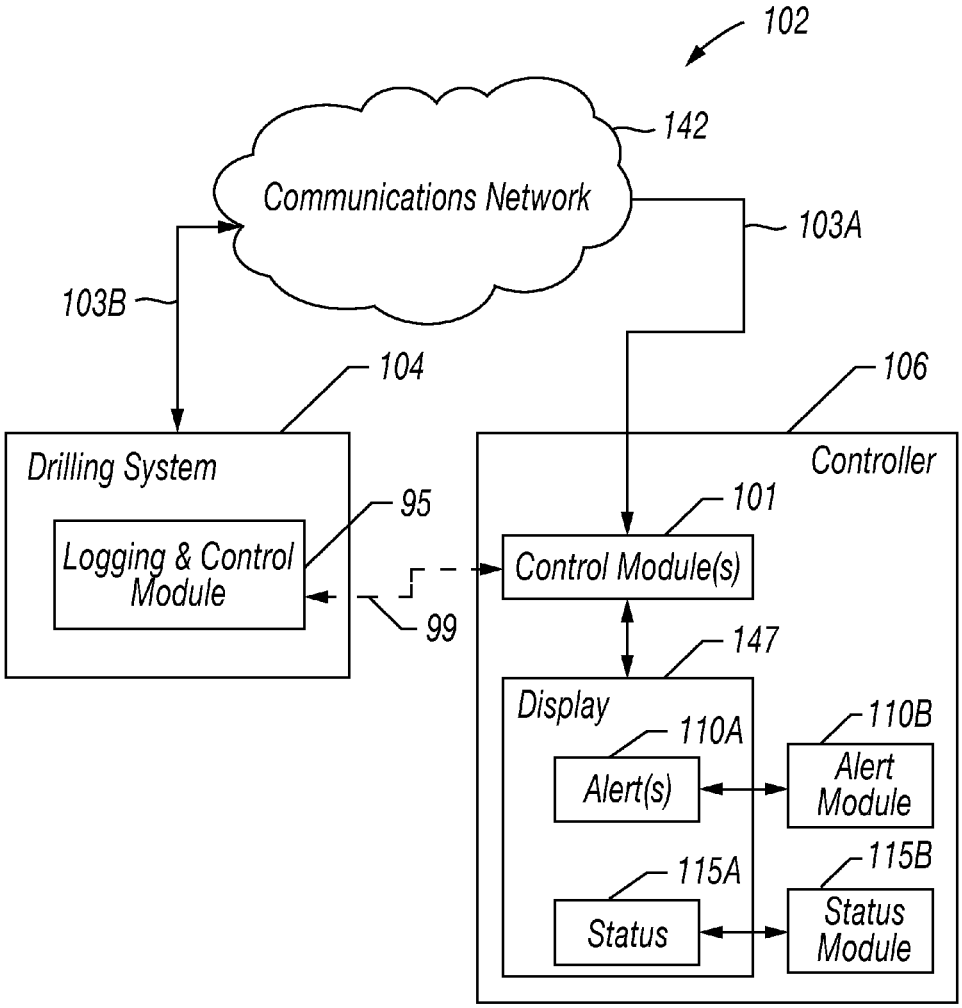
FIG. 1A is a diagram of a system for controlling and monitoring a drilling operation.

Referring initially to FIG. 1A, this figure is a diagram of a system 102 for controlling and monitoring a drilling operation. The system 102 includes a controller module 101 that is part of a controller 106. The system 102 also includes a drilling system 104 which has a logging and control module 95. The controller 106 further includes a display 147 for conveying alerts 110A and status information 115A that are produced by an alerts module 110B and a status module 115B. The controller 102 may communicate with the drilling system 104 via a communications network 142.

The controller 106 and the drilling system 104 may be coupled to the communications network 142 via communication links 103. Many of the system elements illustrated in FIG. 1A are coupled via communications links 103 to the communications network 142.

The links 103 illustrated in FIG. 1A may include wired or wireless couplings or links. Wireless links include, but are not limited to, radio-frequency ("RF") links, infrared links, acoustic links, and other wireless mediums. The communications network 142 may include a wide area network ("WAN"), a local area network ("LAN"), the Internet, a Public Switched Telephony Network ("PSTN"), a paging network, or a combination thereof. The communications network 142 may be established by broadcast RF transceiver towers (not illustrated). However, one of ordinary skill in the art recognizes that other types of communication devices besides broadcast RF transceiver towers are included within the scope of this disclosure for establishing the communications network 142.

The drilling system 104 and controller 106 of the system 102 may have RF antennas so that each element may establish wireless communication links 103 with the communications network 142 via RF transceiver towers (not illustrated). Alternatively, the controller 106 and drilling system 104 of the system 102 may be directly coupled to the communications network 142 with a wired connection. The controller 106 in some instances may communicate directly with the drilling system 104 as indicated by dashed line 99 or the controller 106 may communicate indirectly with the drilling system 104 using the communications network 142.

The controller module 101 may include software or hardware (or both). The controller module 101 may generate the alerts 110A that may be rendered on the display 147. The alerts 110A may be visual in nature but they may also include audible alerts as understood by one of ordinary skill in the art.

The display 147 may include a computer screen or other visual device. The display 147 may be part of a separate stand-alone portable computing device that is coupled to the logging and control module 95 of the drilling system 104. The logging and control module 95 may include hardware or software (or both) for direct control of a bottom hole assembly 100 as understood by one of ordinary skill in the art.

Figure 1B:
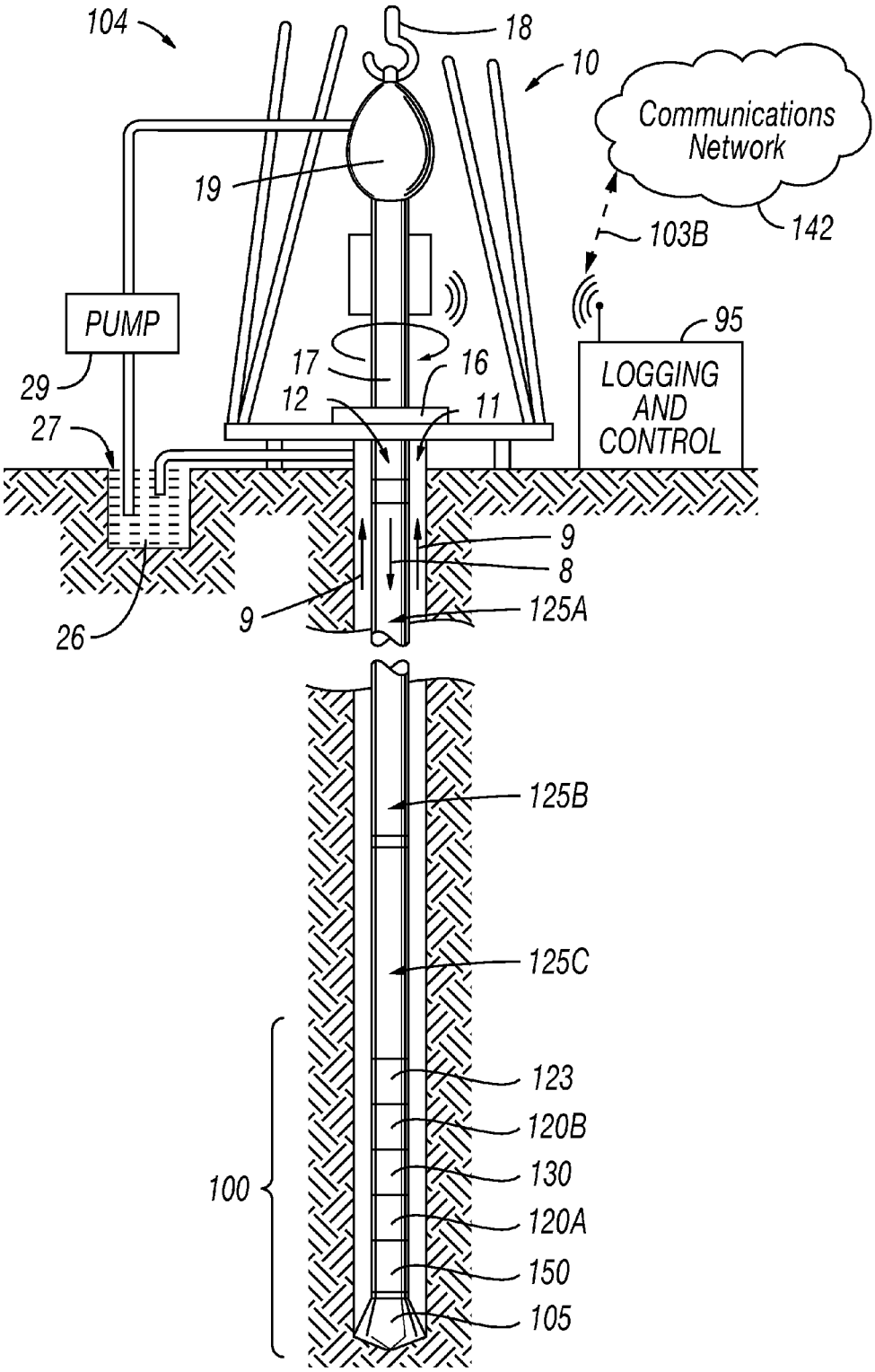
FIG. 1B is a diagram of a wellsite drilling system that forms part of the system illustrated in FIG. 1A.

FIG. 1B illustrates a wellsite drilling system 104 that forms part of the system 102 illustrated in FIG. 1A. The wellsite can be onshore or offshore. In this system 104, a borehole 11 is formed in subsurface formations by rotary drilling in a manner that is known to one of ordinary skill in the art. Embodiments of the system 104 can also use directional drilling, as will be described hereinafter. The drilling system 104 includes the logging and control module 95 as discussed above in connection with FIG. 1A.

A drill string 12 is suspended within the borehole 11 and has a bottom hole assembly ("BHA") 100, which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and the rotary swivel 19, which permits rotation of the drill string 12 relative to the hook 18. As is known to one of ordinary skill in the art, a top drive system could alternatively be used instead of the kelly 17 and rotary table 16 to rotate the drill string 12 from the surface. The drill string 12 may be assembled from a plurality of segments 125 of pipe and/or collars threadedly joined end to end.

In the embodiment of FIG. 1B, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12, as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this system as understood by one of ordinary skill in the art, the drilling fluid 26 lubricates the drill bit 105 and carries formation cuttings up to the surface as it is returned to the pit 27 for cleaning and recirculation.

The bottom hole assembly 100 of the illustrated embodiment may include a logging-while-drilling (LWD) module 120, a measuring-while-drilling (MWD) module 130, a roto-steerable system and motor 150, and the drill bit 105.

The LWD module 120 is housed in a special type of drill collar, as is known to one of ordinary skill in the art, and can contain one or a plurality of known types of logging tools. Also, it will be understood that more than one LWD 120 and/or MWD module 130 can be employed, e.g., as represented at 120A. (References, throughout, to a module at the position of 120A can alternatively mean a module at the position of 120B as well.) The LWD module 120 includes capabilities for measuring, processing, and storing information, as well as for communicating with the surface equipment. In the present embodiment, the LWD module 120 includes a directional resistivity measuring device.

The MWD module 130 is also housed in a special type of drill collar, as is known to one of ordinary skill in the art, and can contain one or more devices for measuring characteristics of the drill string 12 and the drill bit 105. The MWD module 130 may further include an apparatus (not shown) for generating electrical power to the downhole system 100.

This apparatus typically may include a mud turbine generator powered by the flow of the drilling fluid 26, although it should be understood by one of ordinary skill in the art that other power and/or battery systems may be employed. In the embodiment, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

The foregoing examples of wireline and drill string conveyance of a well logging instrument are not to be construed as a limitation on the types of conveyance that may be used for the well logging instrument. Any other conveyance known to one of ordinary skill in the art may be used, including without limitation, slickline (solid wire cable), coiled tubing, well tractor and production tubing.

The drilling system can include a rotary steerable system having an LWD tool or caliper that uses one or more moveable pads to push the drill bit in a particular direction. These moveable pads typically are hinged on one side and are activated by hydraulic pistons or other suitable means to create side forces. A similar mechanical construction can be used for the moveable arm that measures the borehole size.

The movable pad contains electronics that receive power from the drill collar, but without using wires between the pad and the drill collar. Instead, power can be provided by an alternating magnetic field that has a transmitting coil in the drill collar and a receiving coil in the movable pad. The distance between the moveable pad and the drill collar is monitored by measuring the coupling between the transmitting and receiving coils. Alternatively, the movable pad contains a second coil that transmits an alternating magnetic field that is measured by a sensor in the drill collar.

Figure 2A:
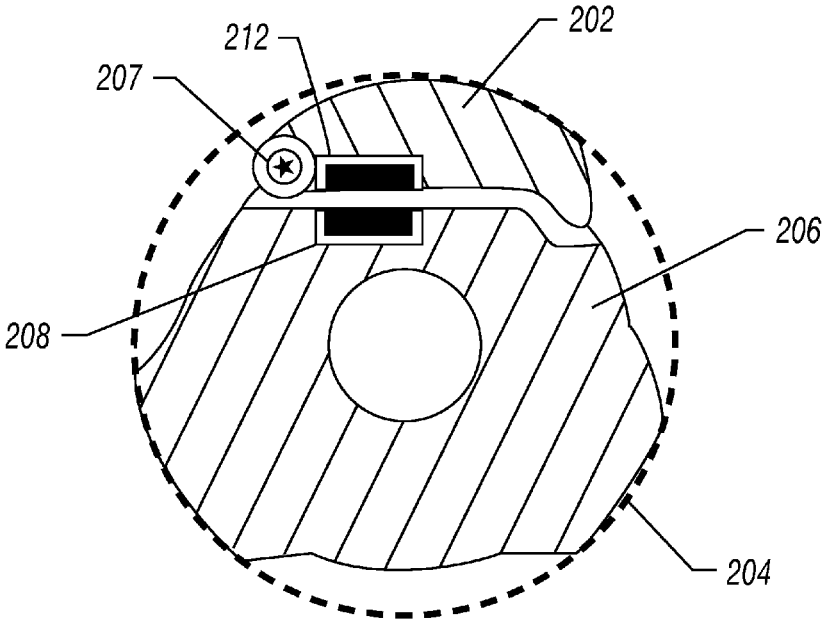
FIG. 2A is a cross-sectional diagram of a mechanical caliper system having a movable pad in a closed position.
Figure 2B:
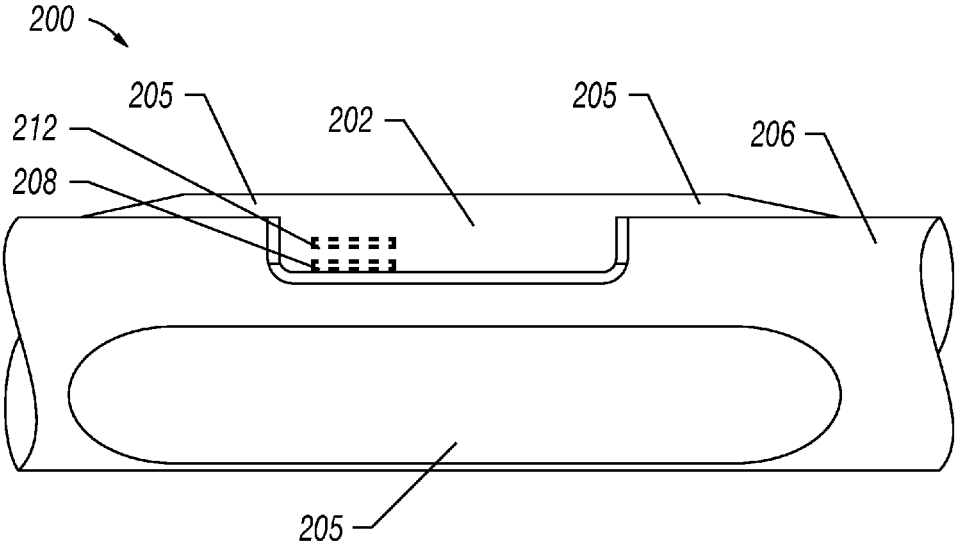
FIG. 2B is a diagram of a mechanical caliper system having a movable pad in a closed position.

FIGS. 2A and 2B illustrate a mechanical caliper system 200 having a movable pad 202 in a closed position. The mechanical caliper system 200 also has fixed pads 205.

Figure 3A:
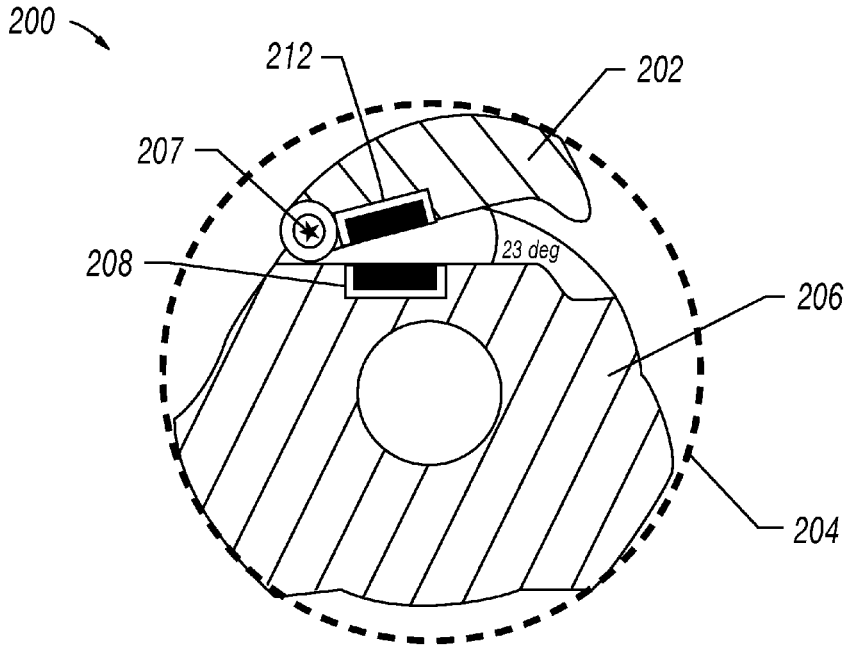
FIG. 3A is a cross-sectional diagram of a mechanical caliper system having a movable pad in an open position.
Figure 3B:
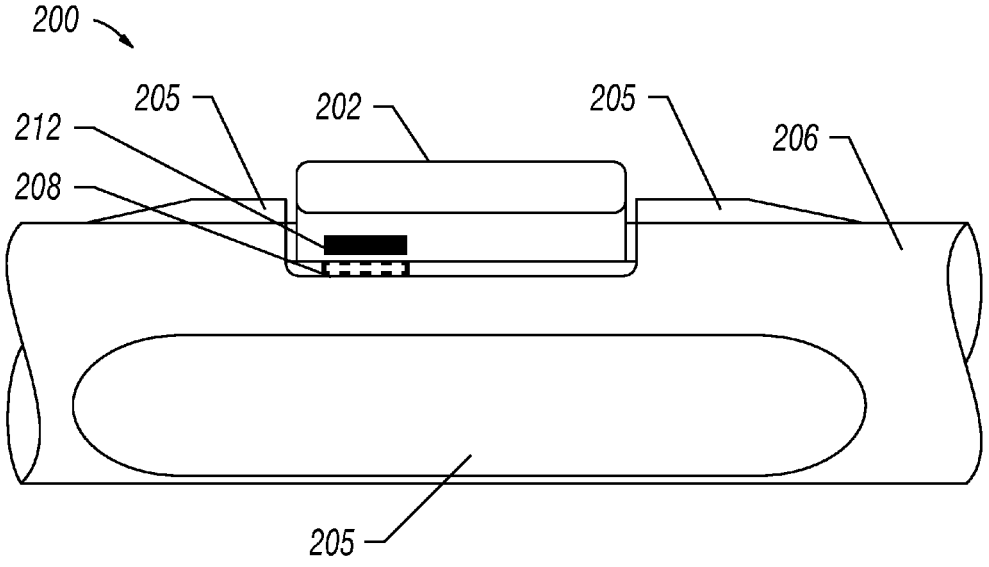
FIG. 3B is a diagram of a mechanical caliper system having a movable pad in an open position.

FIGS. 3A and 3B illustrate the mechanical caliper system 200 having the movable pad 202 in an open position. The movable pad 202 is urged open so that it contacts the borehole wall 204. The movable pad 202 is coupled to a drill collar 206 using a hinge 207 or other suitable means.

The degree of pad opening corresponds to the borehole diameter and borehole shape in case the borehole is not circular. If the LWD tool rotates, then the pad opening can be measured versus the tool face angle, thus providing a 360 degree caliper. There are various means for forcing the movable pad 202 against the borehole wall 204, such as a spring or hydraulic piston or other suitable means.

Figure 4:
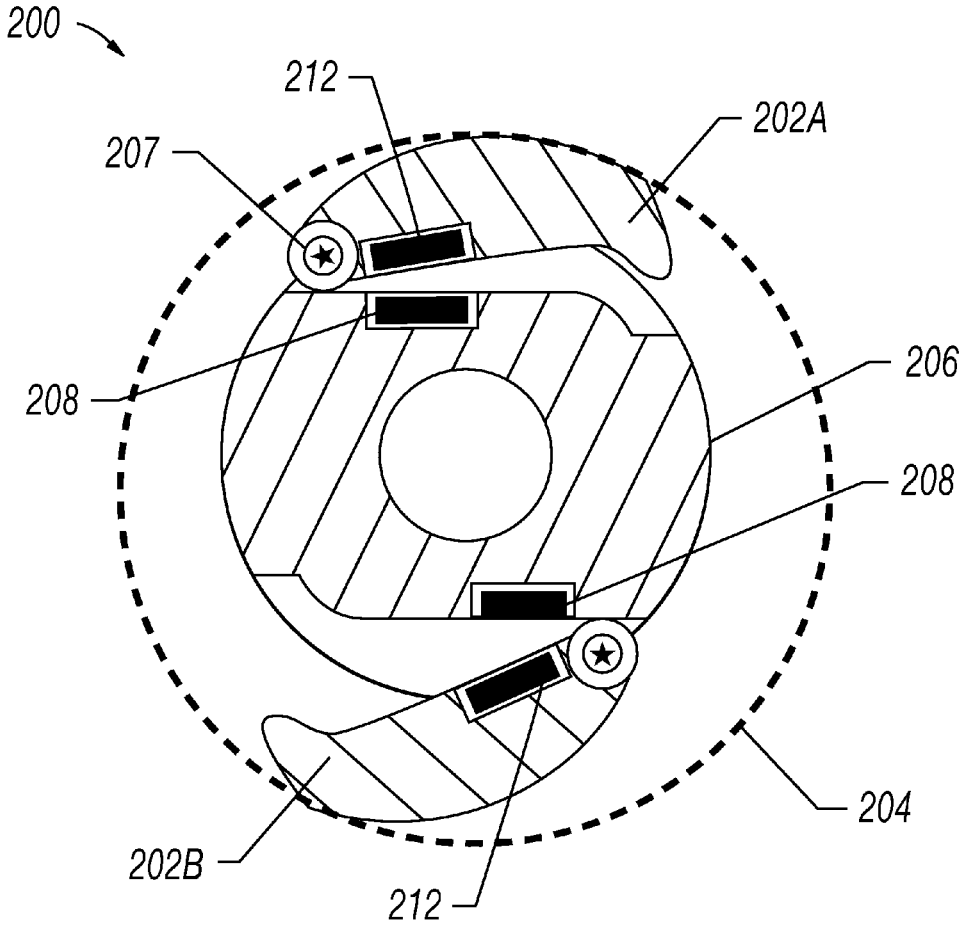
FIG. 4 is a cross-sectional diagram of a mechanical caliper system having two movable pads.

FIGS. 2 and 3 show only one movable pad 202, however, other suitable configurations are possible. For example, FIG. 4 illustrates is a cross-sectional diagram of a mechanical caliper system 200 having two movable pads 202A and 202B.

Because the movable pad 202 continually moves in and out with changing borehole diameters or as the drill collar 206 rotates, connecting the pad to the drill collar 206 with wires is impractical and would result in low reliability. Consider a typical situation where the drill collar 206 rotates at 180 rotations per minute (RPM) and the movable pad 202 flexes each revolution. In a 100 hour bit run, the movable pad 202 moves 100 hr·3600 S/hr·3 RPS=1,080,000 times. This may lead to wire fatigue. Such wires might also be pinched by the pad closing with cuttings present. The movable pad 202 can be powered instead without the use of wires by installing a power transmitter 208 on the drill collar 206 and a power receiver 212 on the movable pad 202.

The power transmitter 208 may include a multi-turn coil, e.g., wrapped on a ferrite core. The power receiver 212 can be a coil mounted in the movable pad 202 and also with a ferrite core to enhance the coupling between the power transmitter 208 and the power receiver 212. Possible positions of the power transmitter 208 and the power receiver 212 are indicated in FIGS. 2 and 3. For example, the power transmitter 208 and the power receiver 212 are recessed into pockets in the drill collar 206 and the movable pad 202, respectively. The power transmitter 208 and the power receiver 212 are in relatively close proximity when the movable pad 202 is closed, but separated a distance d when the movable pad 202 is open.

Figure 5:
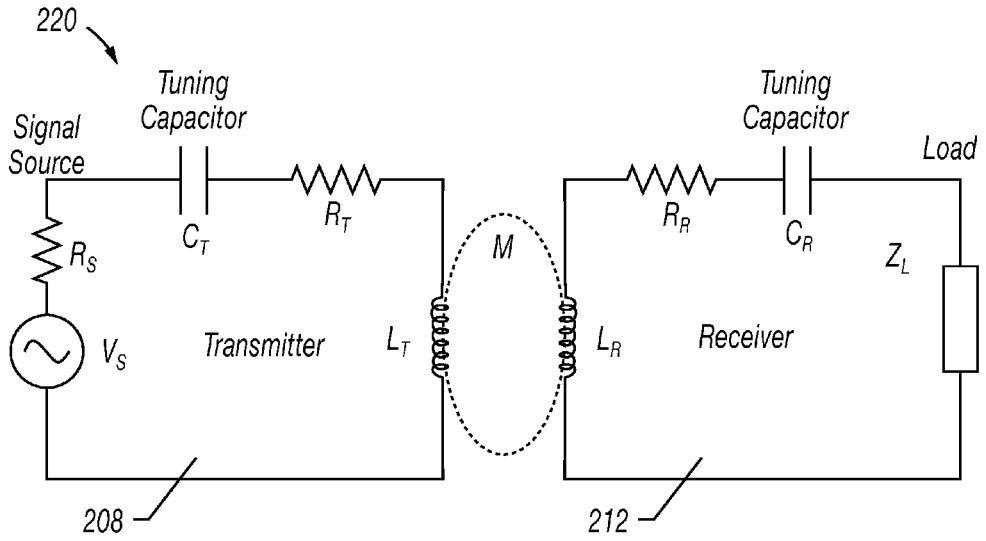
FIG. 5 is a circuit diagram of a power transmitter and power receiver for a mechanical caliper system having at least one movable pad.

FIG. 5 is a circuit diagram 220 of the power transmitter 208 and the power receiver 212. The drill collar 206 contains a voltage source $V_S$ having source resistance $R_S$. The power transmitter 208 has self-inductance $L_T$ and resistance $R_T$. A series tuning capacitor $C_T$ is chosen such that it cancels the transmitter coil inductance at the operating frequency $$f = \frac{1}{2\pi\sqrt{L_T C_T}}.$$

A typical frequency might be in the 50 kHz to 300 kHz range. On the moveable pad 202, the power receiver 212 has self inductance $L_R$ and resistance $R_R$. A series tuning capacitor $C_R$ is chosen such that it cancels the receiver coil inductance at the operating frequency $$f = \frac{1}{2\pi\sqrt{L_R C_R}}.$$

As is well known, the coils may also be placed in resonance by capacitors placed in parallel with the coils. In either series or parallel tuning, the above equations for the resonant frequency apply. In addition, both coils may be associated with high quality factors, defined as:

$$Q_T = \frac{2\pi f L_T}{R_T} \text{ and } Q_R = \frac{2\pi f L_R}{R_R}.$$

The quality factors, Q, may be greater than or equal to about 10 and in some embodiments greater than or equal to about 100. As is understood by one of ordinary skill in the art, the quality factor of a coil is a dimensionless parameter that characterizes the coil's bandwidth relative to its center frequency and, as such, a higher Q value may thus indicate a lower rate of energy loss as compared to coils with lower Q values.

The mutual inductance between the two coils is M, and the coupling coefficient k is defined as:

$$k = \frac{M}{\sqrt{L_T L_R}}.$$

While a conventional inductive coupler has $k \approx 1$, weakly coupled coils may have a value for k less than 1 such as, for example, less than or equal to about 0.9. If the coils are loosely coupled such that $k<1$, then efficient power transfer may be achieved provided the figure of merit, U, is larger than 1 such as, for example, greater than or equal to about 3: $U=k\sqrt{Q_T Q_R} \geq 3$.

The remainder of the electronics and electrical components in the pad are represented by the load impedance $Z_L$. The optimum power transfer occurs when the impedances are chosen such that $R_S=R_T\sqrt{1+k^2 Q_T Q_R}$ and $Z_L=R_R\sqrt{1+k^2 Q_T Q_R}$. These impedances may be accomplished by choice of component values or by the use of matching circuits, as is well known.

The power transmitter 208 produces an alternating magnetic field whose flux generates a voltage in the power receiver 212. This induced voltage drives a current in the receiver circuitry that provides power to the load. Other circuit elements, not shown, may be used to improve the efficiency of the power transfer to the movable pad 202 or to store power, such as rechargeable batteries.

Figure 6A:
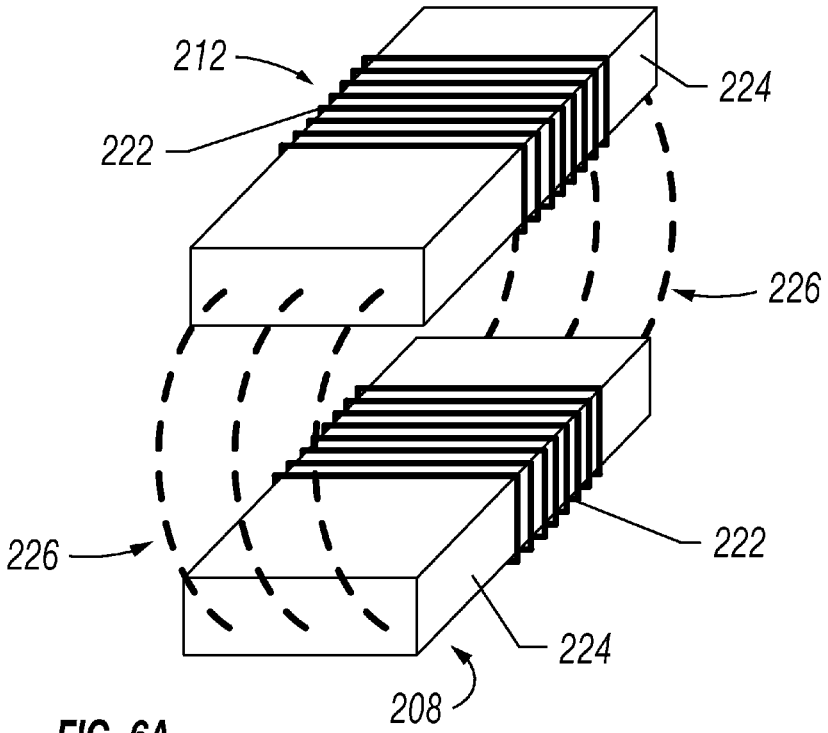
FIG. 6A is a diagram of a power transmitter and power receiver, for a mechanical caliper system having at least one movable pad, in a closed position.
Figure 6B:
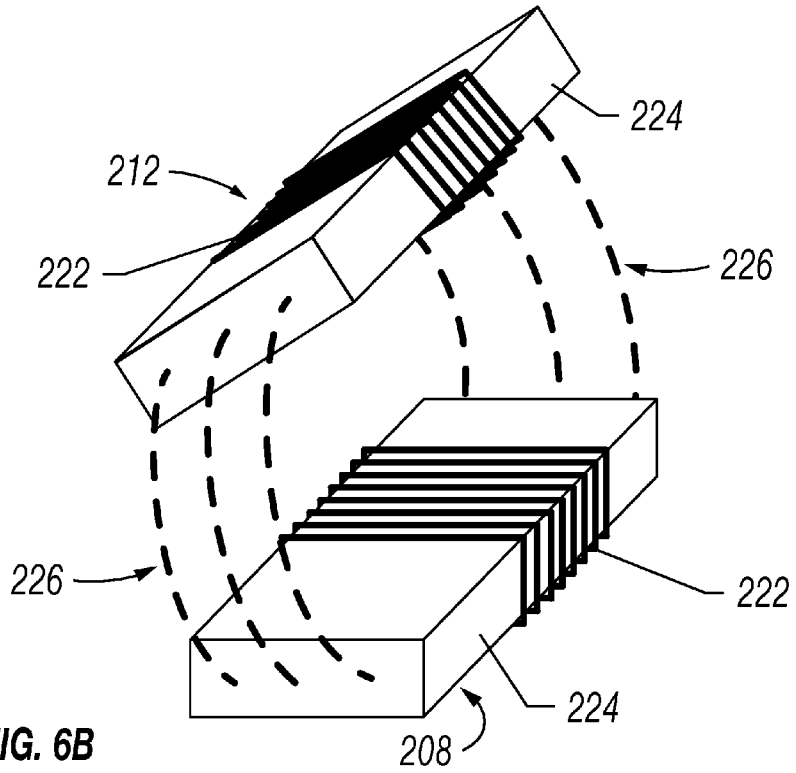
FIG. 6B is a diagram of a power transmitter and power receiver, for a mechanical caliper system having at least one movable pad, in an open position.

An example showing one possible arrangement of the power transmitter 208 and the power receiver 212 is shown in FIGS. 6A and 6B. FIG. 6A illustrates the power transmitter 208 and the power receiver 212 in a closed position. FIG. 6B illustrates the power transmitter 208 and the power receiver 212 in an open position.

A set of coils 222 wrapped around a ferrite core 224 are oriented such that the magnetic poles are aligned with the axis of the hinge 207 (not shown). The ferrite cores 224 may be rectangular in shape and wrapped with multiple turns of wire. FIG. 6A illustrates the closed pad position where the ferrite cores 224 are parallel to each other. FIG. 6B illustrates an open pad position with the cores 224 separated and tilted at an angle. A magnetic flux 226 linking the two ferrite cores 224 is indicated by the dashed lines. The coupling is strongest when the movable pad 202 is closed and falls off as the movable pad 202 is progressively opened.

There are other possible arrangements of the power transmitter 208 and the power receiver 212. For example, the magnetic poles could be perpendicular to the hinge axis, rather than parallel. The ferrites could be rods, rather than rectangular solids. Other power transmitter and receiver arrangements are described hereinbelow.

The position of the movable pad 202 relative to the drill collar 206 can be obtained in different ways. One way is to monitor the voltage in the power receiver 212 if the voltage decreases as the movable pad 202 is progressively opened. Such would be the case for the arrangement shown in FIGS. 2-4. The received voltage is digitized and transmitted back to the drill collar 206 via the same coupler. The coupler also can act as a telemetry device, e.g., by adding transmit and receive circuitry. This typically involves additional electronics to be mounted in the moveable pad 202 to perform the voltage measurement, analog to digital (A/D) conversion, data processing and telemetry functionality.

Figure 7A:
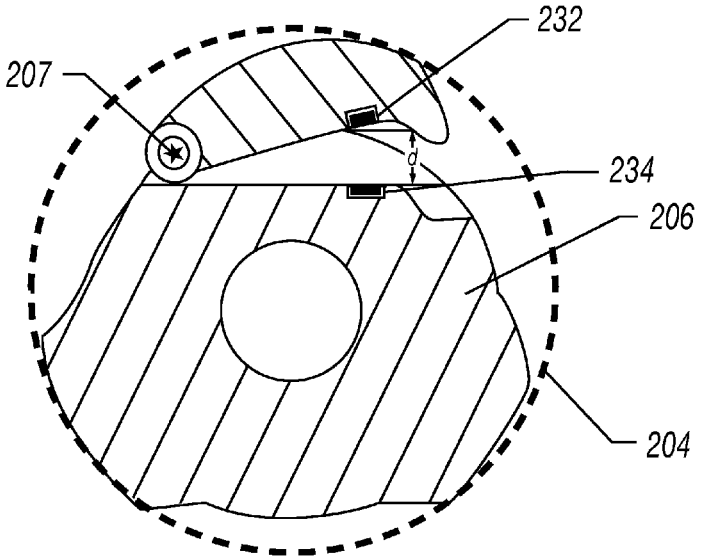
FIG. 7A is a cross-sectional diagram of a mechanical caliper system having a movable pad with a using a solenoid and magnetometer to measure the position of a movable pad.
Figure 7B:
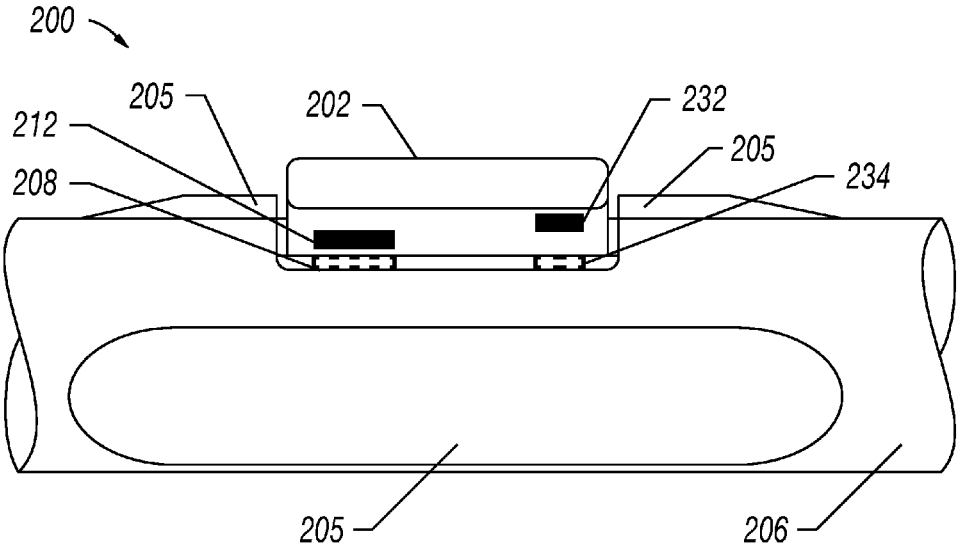
FIG. 7B is a diagram of a mechanical caliper system having a movable pad with a using a solenoid and magnetometer to measure the position of a movable pad.

An alternative approach to measuring the pad position is illustrated in FIGS. 7A and 7B, in which a solenoid 232 is mounted in the moveable pad 202. A magnetometer 234 is located in the drill collar 206 opposite the solenoid 232. The magnetometer 234 is located away from the power transmitter 208 to provide some isolation from the magnetic field generated by the power transmitter 208.

The solenoid 232 generates a second magnetic field at a different frequency than that of the power transmitter 208. The magnetometer 234 has a bandpass filter that passes the signal from the solenoid 232, but blocks the signal from the power transmitter 208. The magnetometer signal thus depends on the separation between the moveable pad 202 and the drill collar 206. For example, suppose that the length of the solenoid 232 is 2D=50 mm, and has its axis parallel to the hinge axis. The magnetometer 234 in the drill collar 206 is centered on the solenoid 232 when the movable pad 202 is closed. The magnetic signal B of the magnetometer 234 approximately varies with the distance d between the solenoid 232 and the magnetometer 234 according to the equation:

$$B \propto \frac{D}{(D^2 + d^2)^{3/2}}.$$

Figure 8:
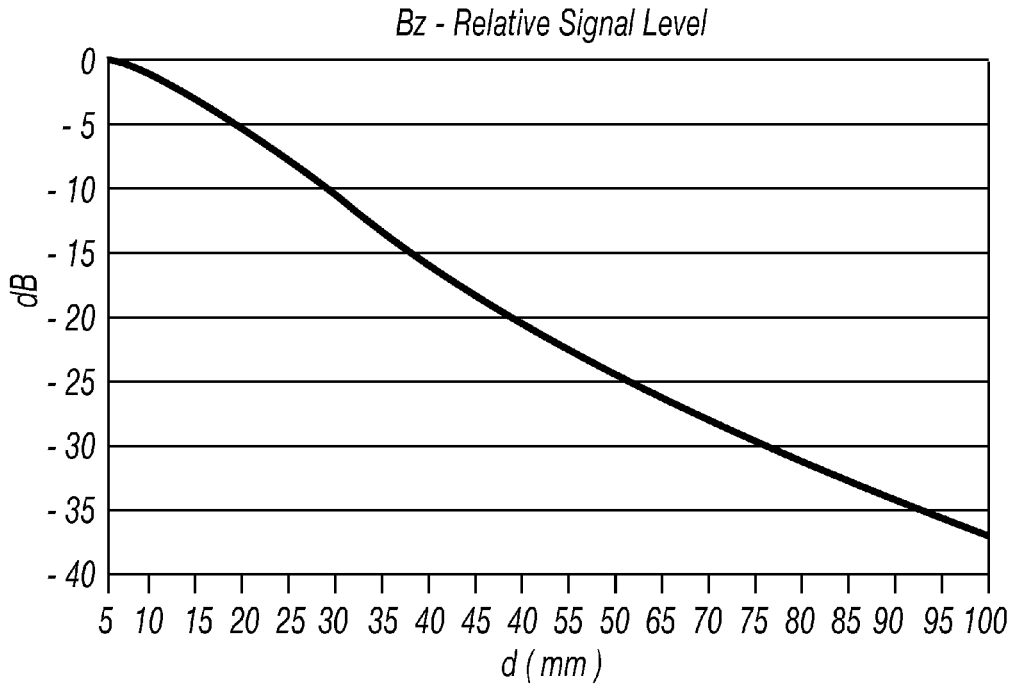
FIG. 8 is a plot diagram of the magnetic signal B as a function of the distance d between the solenoid and the magnetometer in FIGS. 7A and 7B.

An alternative to using this equation is to measure the magnetometer signal versus the moveable pad position, and to form a look-up table of pas position versus the magnetometer signal. The magnetic field is plotted versus distance d in FIG. 8, according to the above equation. The distance between the solenoid 232 and the magnetometer 234 is assumed to be d=5 mm when the movable pad 202 is closed. When the movable pad 202 is open, and the distance is d=100 mm, the magnetic field is down by 36 dB, assuming a constant current in the solenoid 232. Therefore, there exists a relatively consistent relationship between the magnetic field B and the distance d in terms of dynamic range. The reading of the magnetometer 234 thus can be directly related to the distance d, and therefore related to the size of the borehole 204.

Figure 9:
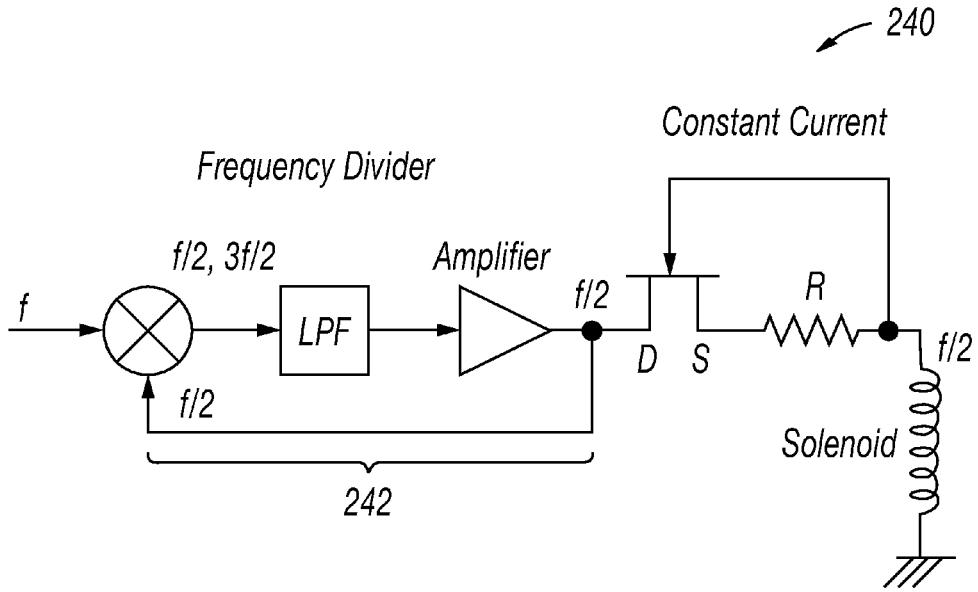
FIG. 9 is a circuit diagram for driving the solenoid in FIGS. 7A and 7B.

FIG. 9 illustrates a circuit diagram 240 that can be used to implement the relationship between the magnetic field B of the magnetometer 234 and the distance d between the solenoid 232 and the magnetometer 234 is illustrated in FIG. 9. The broadcast frequency f is downshifted to f/2 by a "frequency divider" receiver circuit 242. The current driving the solenoid 232 is controlled to a constant value. This maintains a constant magnetic moment in the solenoid 232.

The output of the magnetometer 234 is bandpass filtered to reject the power transmitter frequency f and the Earth's magnetic field. If the drill collar 206 is rotating, the Earth's magnetic field produces an alternating magnetic signal with a frequency of a few Hertz, e.g., 3 Hz, at 120 RPM. The power transmitter 208 might operate at 100 kHz, and the solenoid 232 might operate at 50 kHz. The bandpass filter can be centered at 50 kHz. The output from the bandpass filter can be converted to a digital value and stored in memory and/or transmitted to the surface. This eliminates the need to transmit data from the movable pad 202 back to the drill collar 206.

There are other possible circuits to perform the frequency down conversion. For example, the input frequency can be converted to a square wave and down converted to f/N using flip-flops. Lower frequencies than f/2 also are possible.

Consider the drill string rotating at 3 Hz, and suppose that the position of the movable pad 202 is recorded every 10 degrees, then there are 36 samples per 0.33 seconds or 108 samples per second. This is easily within the sampling ability of the magnetometer 234.

Figure 10A:
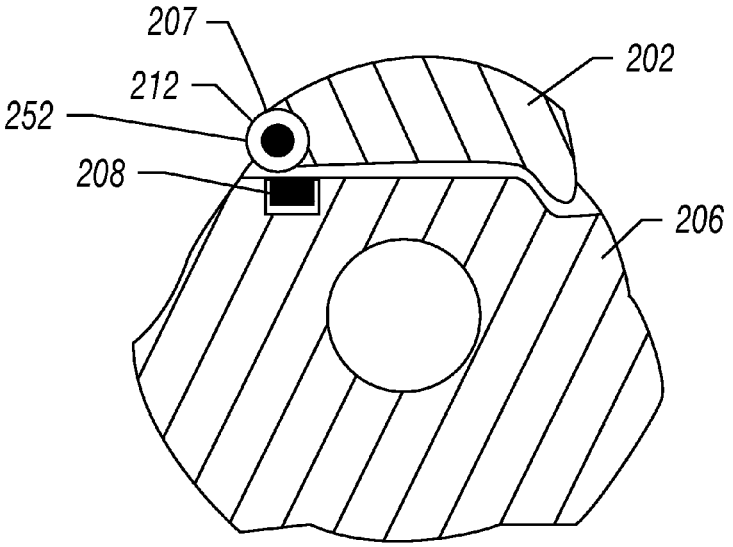
FIG. 10A is a cross-sectional diagram of a mechanical caliper system having a movable pad, illustrating an alternative mounting arrangement for the power transmitter and the power receiver.
Figure 10B:
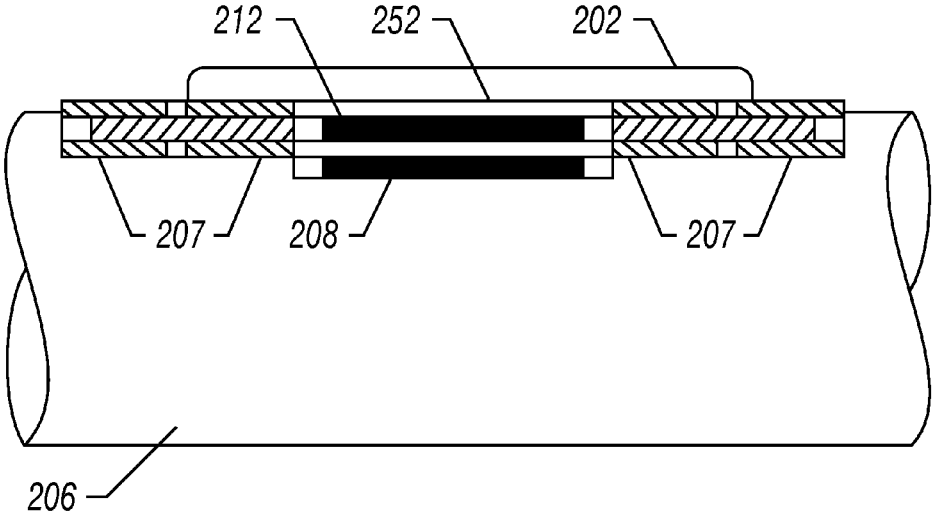
FIG. 10B is a diagram of a mechanical caliper system having a movable pad, illustrating an alternative mounting arrangement for the power transmitter and the power receiver.

There are other possible arrangements for the power transmitter 208 and the power receiver 212. For example, FIGS. 10A and 10B illustrate the power receiver 212 mounted on the hinge axis. The hinge mechanism 207 has two parts: one on each end of the moveable pad 202. The power receiver 212 may include a ferrite rod with a coil, mounted between the two halves of the hinge 207. The power receiver 212 is mounted in an insulating tube 252, which can be made of polyether ether ketone (PEEK) or other suitable material, to hold the power receiver 212 in place and to protect the power receiver 212 from drilling cuttings and drilling mud. The insulating tube 252 is made of an insulating material to allow the magnetic field to penetrate the insulating tube 252.

A solid metal tube would attenuate the magnetic field alternating at the frequency f. The power transmitter 208 is mounted in the drill collar 206 opposite the power receiver 212. In this mounting configuration, the magnetic coupling is not a function of the position of the movable pad 202, and relatively strong coupling is possible. Because the voltage induced in the power receiver 212 is not a function of the position of the movable pad 202, the separate solenoid 232 and magnetometer 234 are used to monitor the position of the movable pad 202.

Figure 11A:
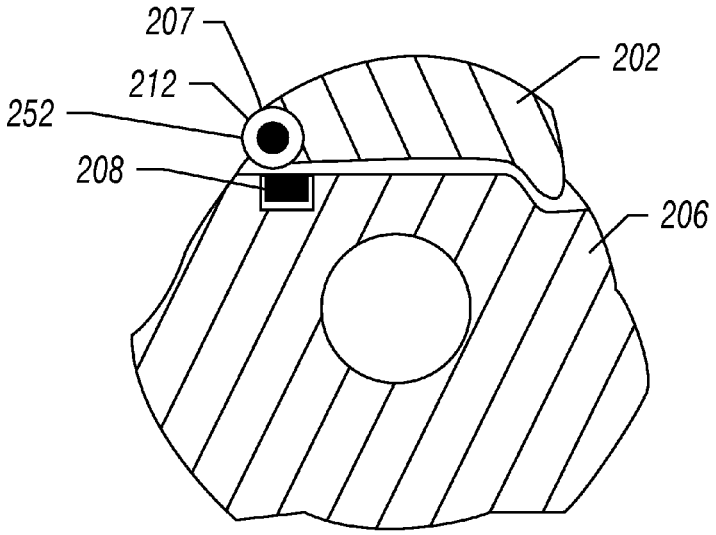
FIG. 11A is a cross-sectional diagram of a mechanical caliper system having a movable pad, illustrating yet alternative mounting arrangement for the power transmitter and the power receiver.
Figure 11B:
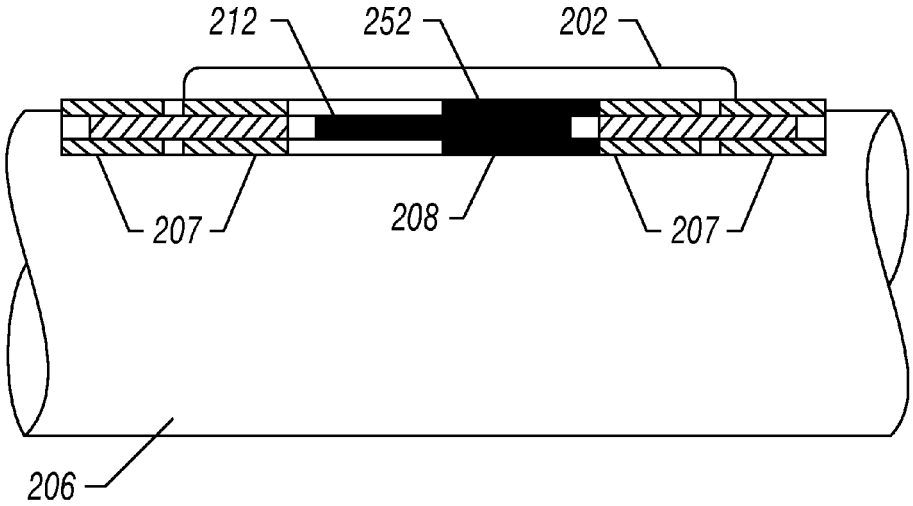
FIG. 11B is a diagram of a mechanical caliper system having a movable pad, illustrating yet alternative mounting arrangement for the power transmitter and the power receiver.

Another configuration of the power transmitter 208 and the power receiver 212 is shown in FIGS. 11A and 11B. In this configuration, both the power transmitter 208 and the power receiver 212 are mounted on the hinge axis. Both the power 208 transmitter and the power receiver 212 are contained inside insulating tubes 252. The insulating tube 252 containing the power receiver 212 is attached to the movable pad 202, while the insulating tube 252 containing the power transmitter 208 is mounted on the drill collar 206. Both ferrites are rods with coils wrapped around them. In this configuration, the power transfer is not a function of the position of the movable pad 202, but the power coupling is relatively efficient, owing to the relative close physical proximity of the two ferrites.

Figure 12A:
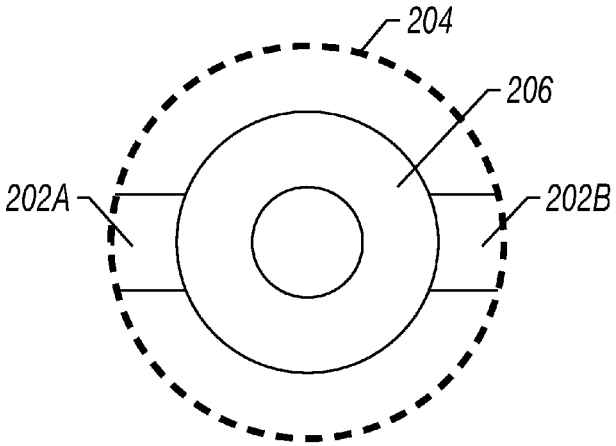
FIG. 12A is a view of a mechanical caliper with arms that extend in planes containing the axis of a drill collar.
Figure 12B:
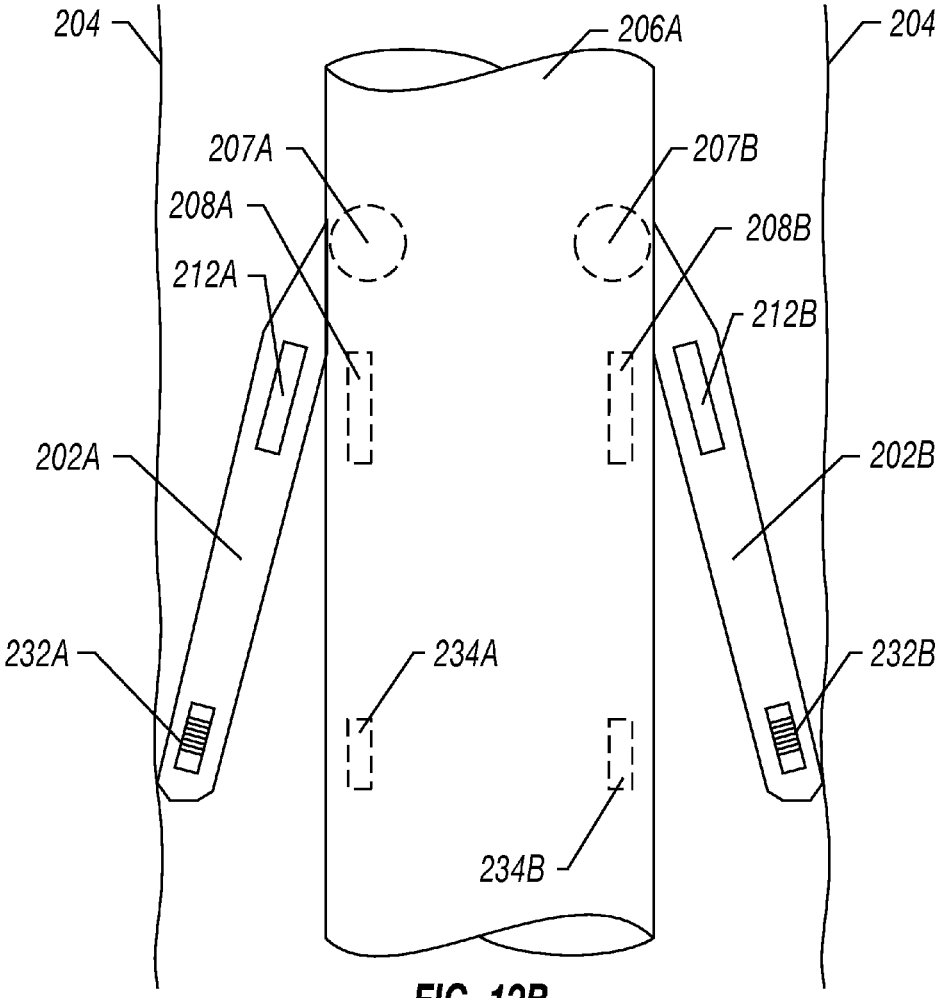
FIG. 12B is a cross-sectional view of a mechanical caliper with arms that extend in planes containing the axis of a drill collar.

Another caliper configuration is shown in FIGS. 12A and 12B. The caliper has arms 202A and 202B that extend in a plane parallel to the axis of the drill collar 206. The arms 202A and 202B could be kept closed during drilling and opened only at the end of drilling. This configuration could be used on a trip out of the borehole prior to running casing into the borehole and then cementing the casing in place. In this situation, the caliper measurement is used to compute the volume of cement needed. The hinges 207A and 207B are above the arms for tripping out, during which time there is minimal rotation of the BHA. The power transmitter 208A and 208B are located in the drill collar 206, and the power receivers 212A and 212B are located in the arms 202A and 202B. The two power transmitters may operate at the dame frequency f or at different frequencies. The two solenoid transmitters 232A and 232B may operate at different frequencies to avoid cross-talk between themselves and the magnetometers 234A and 234B. For example, if power transmitters both operate at the same frequency f, then solenoid 232A may operate at frequency f/N and magnetometer 234A configured to detect only frequencies near f/N. Similarly, solenoid 232B may operate at frequency f/M and magnetometer 234B configured to detect only frequencies near f/M, where N and M are different. The caliper measurements could be stored in memory in the caliper tool, and downloaded to a surface computer. While there are two caliper arms illustrated in FIGS. 12A and 12B, three or four arms could also be used.

Figure 13A:
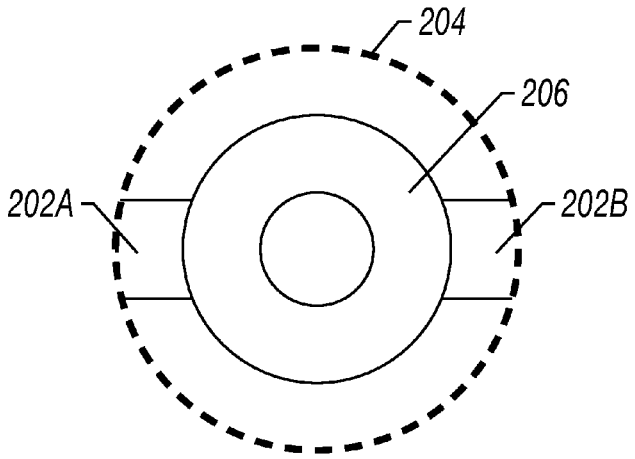
FIG. 13A is a view of an under-reamer with a caliper.
Figure 13B:
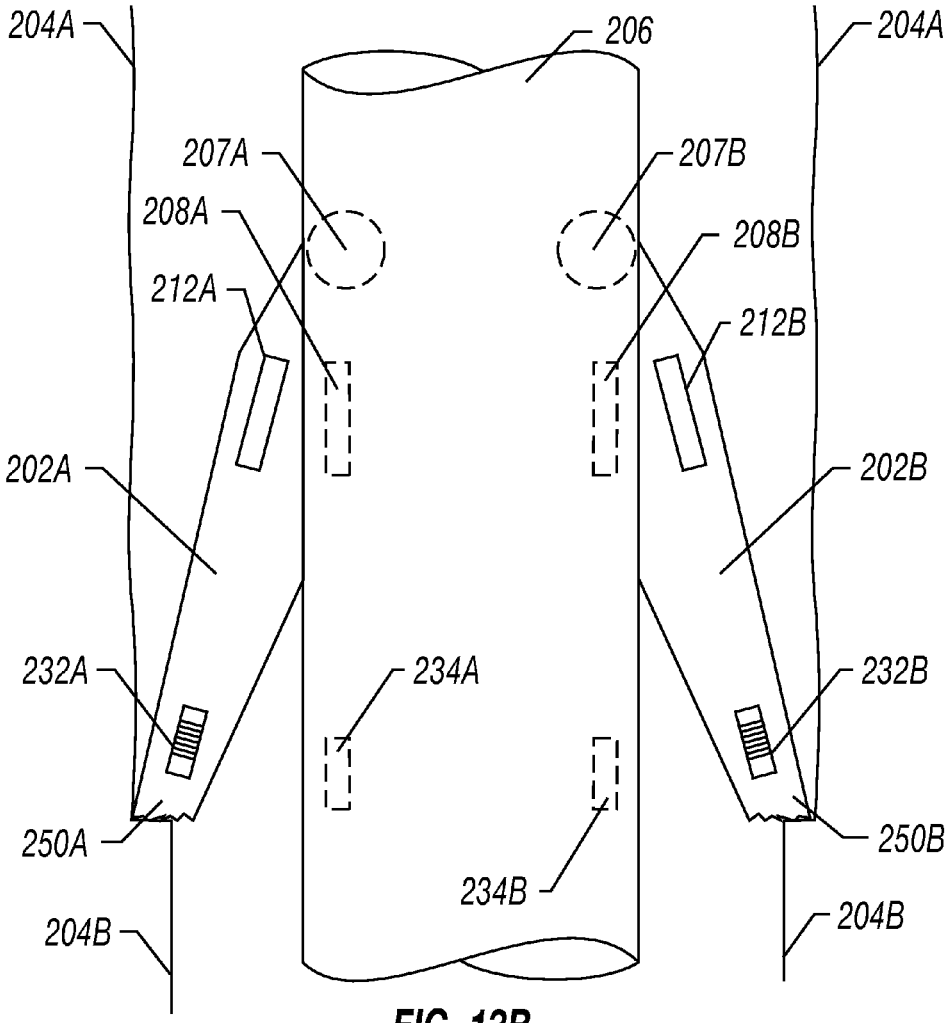
FIG. 13B is a cross-sectional view of an under-reamer with a caliper.

Another application is shown in FIGS. 13A and 13B where the caliper measurement is implemented in an under-reamer. An under-reamer is commonly used to open the diameter of a borehole from the drill bit diameter 204B to the greater diameter 204A. The under-reamer may have two arms or blades 202A and 202B that pivot open with hinges 207A and 207B. The cutting surfaces are 250A and 250B, which enlarge the borehole. It is important to know whether the arms are properly opened, such that the borehole is large enough to accept the casing. The position of the arms 202A and 202B can be measured using solenoids 232A and 232B and magnetometers 234A and 234B. The power to the solenoids is provided by power transmitters 208A and 208B, and power receivers 212A and 212B.

The power transmission and pad position configurations described herein can apply to measurements other than a caliper. For example, the moveable pad can contain electromagnetic, nuclear, or acoustic sensors. These configurations can be used for formation evaluation or for borehole imaging. In either case, knowing the pad position improves the quality of the formation evaluation or borehole imaging measurements.

Although only a few embodiments have been described in detail above, those skilled in the art will readily appreciate that many modifications are possible in the embodiments without materially departing from this invention. Accordingly, all such modifications are intended to be included within the scope of this disclosure as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, sixth paragraph for any limitations of any of the claims herein, except for those in which the claim expressly uses the words 'means for' together with an associated function.

What is claimed is:

1. A method comprising:

providing a first coil within a drill collar;

providing a second coil in the moveable member;

coupling the first and second coils with a coupling coefficient, k, wherein, $k=M/\sqrt{L_1L_2}\leq 0.9$, M is a mutual inductance between the first and second coils, $L_1$ is a first self-inductance of the first coil, and $L_2$ is a second self-inductance of the second coil; and resonantly tuning the first coil at a first frequency, $f_1$, with a first capacitance, $C_1$, and the second coil at a second frequency, $f_2$, with a second capacitance, $C_2$, wherein $f_1$ is approximately equal to $f_2$, $$f_1 = \frac{1}{2\pi\sqrt{L_1C_1}} \text{ and } f_2 = \frac{1}{2\pi\sqrt{L_2C_2}};$$

wherein the first and second coils have a figure of merit, U, wherein $$U = k\sqrt{Q_1Q_2} \geq 3,\ Q_1 = \frac{2\pi f_1 L_1}{R_1},\ Q_2 = \frac{2\pi f_2 L_2}{R_2},$$

$Q_1$ and $Q_2$ comprise respective quality factors associated with the first and second coils, and $R_1$ and $R_2$ comprise respective resistances of the first and second coils.

2. The method as recited in claim 1, further comprising:

approximately matching a source impedance of the first coil, $R_S$, with a load impedance of the second coil, $R_1$, wherein $R_S \approx R_1\sqrt{1+k^2Q_1Q_2}$.

3. The method as recited in claim 1, further comprising:

approximately matching a load impedance of the second coil, $R_1$, with a source impedance of the first coil, $R_S$, wherein $R_L \approx R_2\sqrt{1+k^2Q_1Q_2}$.

4. The method as recited in claim 1, wherein the moveable member measures a borehole diameter.

5. The method as recited in claim 1, wherein the moveable member includes at least one of an electromagnetic measurement sensor, a nuclear measurement sensor, and an acoustic measurement sensor.

6. The method as recited in claim 1, wherein the moveable member is a moveable caliper arm or a moveable pad.

7. The method as recited in claim 1, wherein the moveable member is an under-reamer arm.

8. The method as recited in claim 1, wherein the first coil is coupled to the drill collar and the second coil is coupled to the movable member so that power is transmitted from the first coil to the second coil as a function of a distance between the movable member and the drill collar.

9. The method as recited in claim 1, wherein the moveable member comprises a plurality of movable members each coupled to the drill collar, wherein each of the plurality of movable members has a second coil coupled thereto and each second coil has a corresponding first coil coupled to the drill collar, and wherein each first coil transmits power to a corresponding second coil whereby the corresponding movable member moves between an open position and a closed position.

10. The method as recited in claim 1, further comprising monitoring the position of the movable member relative to the drill collar.

11. A logging while drilling apparatus, comprising:

a drill collar;

a moveable member coupled to the drill collar;

a first coil coupled within the drill collar;

a second coil coupled within the moveable member;

wherein the first and second coils are coupled with a coupling coefficient, k, wherein, $k=M/\sqrt{L_1L_2}\leq 0.9$, M is a mutual inductance between the first and second coils, $L_1$ is a first self-inductance of the first coil, and $L_2$ is a second self-inductance of the second coil, and wherein the first coil is resonantly tuned at a first frequency, $f_1$, with a first capacitance, $C_1$, wherein the second coil is resonantly tuned at a second frequency, $f_2$, with a second capacitance, $C_2$, wherein $f_1$ is approximately equal to $f_2$, $$f_1 = \frac{1}{2\pi\sqrt{L_1C_1}} \text{ and } f_2 = \frac{1}{2\pi\sqrt{L_2C_2}},$$

and wherein the first and second coils have a figure of merit, U, wherein $$U = k\sqrt{Q_1Q_2} \geq 3,\ Q_1 = \frac{2\pi f_1 L_1}{R_1},\ Q_2 = \frac{2\pi f_2 L_2}{R_2},$$

$Q_1$ and $Q_2$ comprise respective quality factors associated with the first and second coils, and $R_1$ and $R_2$ comprise respective resistances of the first and second coils.

12. The apparatus as recited in claim 11, wherein a source impedance of the first coil, $R_S$ is approximately matched with a load impedance of the second coil, $R_1$, wherein $R_S \approx R_1\sqrt{1+k^2Q_1Q_2}$.

13. The apparatus as recited in claim 11, wherein a load impedance of the second coil, $R_1$, is approximately matched with a source impedance of the first coil, $R_S$, wherein $R_L \approx R_2\sqrt{1+k^2Q_1Q_2}$.

14. The apparatus as recited in claim 11, wherein the moveable member measures a borehole diameter.

15. The apparatus as recited in claim 11, wherein the moveable member includes at least one of an electromagnetic measurement sensor, a nuclear measurement sensor, and an acoustic measurement sensor.

16. The apparatus as recited in claim 11, wherein the moveable member is a caliper arm.

17. The apparatus as recited in claim 11, wherein the moveable member is an under-reamer blade.

18. The apparatus as recited in claim 11, wherein the moveable member is a moveable pad.

19. The apparatus as recited in claim 11, wherein the moveable member is coupled to the drill collar in such a way that the movable member is urged in the open position.

20. The apparatus as recited in claim 11, wherein the first coil comprises a multi-turn coil wrapped on a ferrite core, wherein the second coil comprises a multi-turn coil wrapped on a ferrite core, and wherein the first coil is coupled to the drill collar and the second coil is coupled to the movable member such that magnetic poles of the first coil and the magnetic poles of the second coil are aligned with an axis of the drill collar.

21. The apparatus as recited in claim 11, wherein the moveable member comprises a plurality of movable members each coupled to the drill collar, wherein each of the plurality of movable members has a second coil coupled thereto and each second coil has a corresponding first coil coupled to the drill collar, and wherein each first coil transmits power to a corresponding second coil whereby the corresponding movable member moves between an open position and a closed position.

* * * * *